US011515072B2

(12) United States Patent
Yen

(10) Patent No.: US 11,515,072 B2
(45) Date of Patent: Nov. 29, 2022

(54) INDUCTOR DEVICE

(71) Applicant: Realtek Semiconductor Corporation, Hsinchu (TW)

(72) Inventor: Hsiao-Tsung Yen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 720 days.

(21) Appl. No.: 16/293,876

(22) Filed: Mar. 6, 2019

(65) Prior Publication Data

US 2019/0279809 A1 Sep. 12, 2019

(30) Foreign Application Priority Data

Mar. 7, 2018 (TW) ..... 107107742

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |
| ***H01F 19/00*** | (2006.01) |

(52) U.S. Cl.

CPC ..... *H01F 27/2804* (2013.01); *H01F 17/0006* (2013.01); *H01F 19/00* (2013.01); *H01F 27/2823* (2013.01); *H01F 27/29* (2013.01); *H01F 2017/004* (2013.01); *H01F 2017/0073* (2013.01); *H01F 2027/2809* (2013.01); *H01F 2027/2819* (2013.01)

(58) Field of Classification Search

CPC ..... H01F 2017/0073

USPC ..... 336/225–230

See application file for complete search history.

(56) References Cited

U.S. PATENT DOCUMENTS

| | | | | |
|---|---|---|---|---|
| 8,427,388 | B2 | 4/2013 | Fahs et al. | |
| 9,035,713 | B2 * | 5/2015 | Leong | H03H 7/42 333/25 |
| 10,153,078 | B2 | 12/2018 | Yen et al. | |
| 10,186,364 | B2 | 1/2019 | Yen et al. | |
| 2011/0148733 | A1 * | 6/2011 | Fahs | H03H 7/42 343/859 |
| 2018/0330872 | A1 | 11/2018 | Yen et al. | |

FOREIGN PATENT DOCUMENTS

| | | | |
|---|---|---|---|
| TW | 201714278 | A | 4/2017 |

* cited by examiner

*Primary Examiner* — Ronald Hinson
(74) *Attorney, Agent, or Firm* — Locke Lord LLP; Tim Tingkang Xia, Esq.

(57) ABSTRACT

An inductor device includes a first inductor unit and a second inductor unit. The first inductor unit includes a first side to a fourth side, a first wire, and a first input terminal. The first wire is winded to form a plurality of circles. The first wire is winded in an interlaced manner at one of the first to fourth sides of the first inductor unit. The first input terminal is disposed on one of the first to fourth sides. The second inductor unit includes a fifth side to an eighth side, a second wire, and a second input terminal. The second wire is winded to form a plurality of circles. The second wire is winded in an interlaced manner at one of the fifth to eighth sides of the second inductor unit. The second input terminal is disposed on one of the fifth to eighth sides.

19 Claims, 6 Drawing Sheets

INDUCTOR DEVICE

RELATED APPLICATIONS

This application claims priority to Taiwan Application Serial Number 107107742, filed Mar. 7, 2018, which is herein incorporated by reference.

BACKGROUND OF THE INVENTION

Field of Invention

The present disclosure relates to basic electronical elements. More particularly, the present disclosure relates to an inductor device.

Description of Related Art

Performance of a conventional 8-shaped transformer is usually affected due to the structure of the 8-shaped transformer not being symmetrical. Specifically, if the 8-shaped transformer is formed of two circles having structures that are not symmetrical, magnetic field produced from each of the circuits of the two circles would be shifted. For example, if the structures of the two circles are not symmetrical, the magnetic field would be shifted to one side of the two circles. Therefore, the efficiency of the 8-shaped transformer is thereby affected.

SUMMARY OF THE INVENTION

One aspect of the present disclosure is directed to an inductor device. The inductor device comprises a first inductor unit and a second inductor unit. The first inductor unit comprises first to fourth sides, a first wire and a first input terminal. The first side and the second side are respectively disposed at two opposite sides of the first inductor unit. The third side and the fourth side are located at two opposite sides of a first central line. The first central line is across and between the first and second sides. The first wire is winded to form a plurality of circles, where the first wire is winded in an interlaced manner at at least one of the first to fourth sides of the first inductor unit. The first input terminal is disposed on one side of the first side, the second side, the third side and the fourth side of the first inductor unit. The second inductor unit comprises fifth to eighth sides, a second wire and a second input terminal. The fifth side and the sixth side are respectively disposed at two opposite sides of the second inductor unit. The seventh side and the eighth side are located at two opposite sides of a second central line, where the second central line is across and between the fifth and sixth sides. The second wire is winded to form a plurality of circles, where the second wire is winded in an interlaced manner at at least one of the fifth to eighth sides of the second inductor unit. The second input terminal is disposed on one of the fifth to eighth sides of the second inductor unit. The first wire and the second wire are winded in an interlaced manner at the second side and the sixth side.

DETAILED DESCRIPTION

Figure 1:
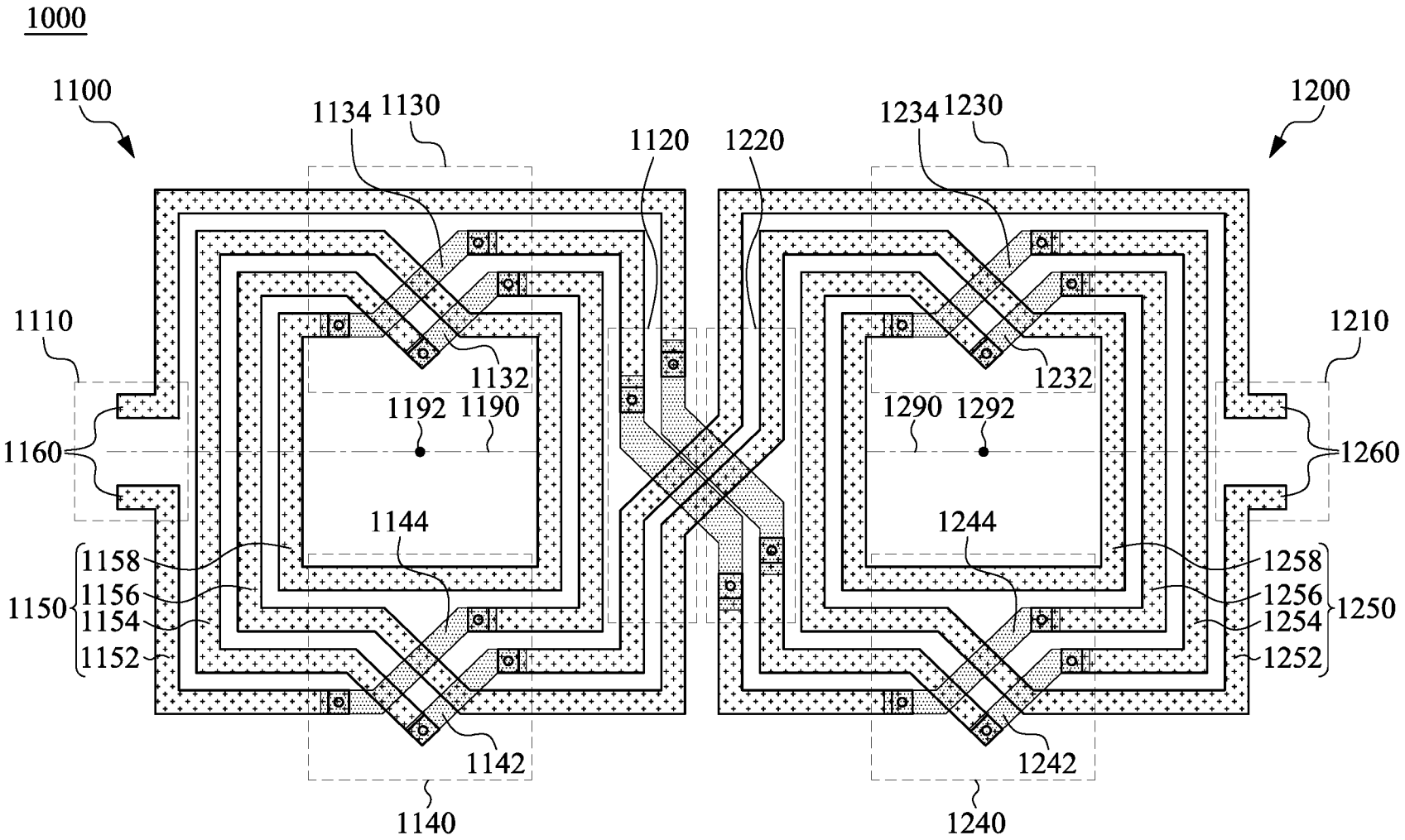
FIG. 1 is a schematic diagram of an inductor device according to some embodiments of the present disclosure.

FIG. 1 is a schematic diagram of an inductor device 1000 according to some embodiments of the present disclosure. As shown in figure, the inductor device 1000 includes a first inductor unit 1100 and a second inductor unit 1200. The first inductor unit 1100 includes a first side 1110, a second side 1120, a third side 1130, a fourth side 1140, a first wire 1150 and a first input terminal 1160. The first side 1110 and the second side 1120 are respectively disposed at two opposite sides of the first inductor unit 1100. The third side 1130 and the fourth side 1140 are located at two opposite sides of a first central line 1190. The first central line 1190 is across and between the first and second sides 1110 and 1120. The first wire 1150 is winded to form a plurality of circles, where the first wire 1150 is winded in an interlaced manner at at least one of the first to fourth sides 1110 to 1140 of the first inductor unit 1100. The first input terminal 1160 is disposed on one side of the first side 1110, the second side 1120, the third side 1130 and the fourth side 1140 of the first inductor unit 1110.

Furthermore, the second inductor unit 1200 includes a fifth side 1210, a sixth side 1220, a seventh side 1230, an eighth side 1240, a second wire 1250 and a second input terminal 1260. The fifth side 1210 and the sixth side 1220 are respectively disposed at two opposite sides of the second inductor unit 1200. The seventh side 1230 and the eighth side 1240 are located at two opposite sides of a second central line 1290, where the second central line 1290 is across and between the fifth and sixth sides 1210 and 1220. The second wire 1250 is winded to form a plurality of circles, where the second wire 1250 is winded in an interlaced manner at at least one of the fifth to eighth sides 1210 to 1240 of the second inductor unit 1200. The second input terminal 1260 is disposed on one of the fifth to eighth side 1210 to 1240 of the second inductor unit 1200. The first wire 1150 and the second wire 1250 are winded in an interlaced manner at the second side 1120 and the sixth side 1220.

In one embodiment, the first wire 1150 includes two gaps located the third side 1130. The first inductor unit 1100 includes two connecting members 1132 and 1134 that are disposed at the third side 1130 and located on the first wire 1150. The two connecting members 1132 and 1134 are configured to connect two ends of the two gaps. In another embodiment, the first wire 1150 includes two gaps located the fourth side 1140. The first inductor unit 1100 includes two connecting members 1142 and 1144 that are disposed at the fourth side 1140 and located on the first wire 1150. The two connecting members 1142 and 1144 are configured to connect two ends of the two gaps.

In yet another embodiment, the second wire 1250 includes two gaps located at the seventh side 1230. The second inductor unit 1200 includes two connecting members 1232 and 1234 that are disposed at the seventh side 1230 and located on the second wire 1250. The two connecting members 1232 and 1234 are configured to connect two ends of the at least two gaps. In one embodiment, the second wire 1250 includes two gaps located at the eighth side 1240. The second inductor unit 1200 includes two connecting members 1242 and 1244 that are disposed at the eighth side 1240 and located on the second wire 1250. The two connecting members 1242 and 1244 are configured to connect two ends of the at least two gaps.

In still another embodiment, the first wire 1150 includes a first circle 1152, a second circle 1154, a third circle 1156 and a fourth circle 1158, and the second wire includes a fifth circle 1252, a sixth circle 1254, a seventh circle 1256 and an eighth circle 1258. The first wire 1150 is winded from the first side 1110 upward to the second side 1120 along the first circle 1152 and then winded in an interlaced manner into the sixth circle 1254 of the second wire 1250. Next, the first wire 1150 is winded to the eighth side 1240 along the sixth circle 1254 and then winded in an interlaced manner into the sixth circle 1254 through the connecting member 1242. Next, the first wire 1150 is winded to the seventh side 1230 along the sixth circle 1254 and then winded in an interlaced manner into the eighth circle 1258 through the connecting member 1234. The second wire 1250 is winded to the seventh side 1230 along the eighth circle 1258 around the center point 1292 and then winded in an interlaced manner into the sixth circle 1254. Next, the second wire 1250 is winded to the sixth side 1220 along the sixth circle 1254 and then winded in an interlaced manner into the first circle 1152 of the first wire 1150.

Then, the first wire 1150 is winded to the fourth side 1140 along the first circle 1152 and then winded in an interlaced manner into the third circle 1156. Next, the first wire 1150 is winded to the third side 1130 along the third circle 1156 and then winded in an interlaced manner into the third circle 1156 through the connecting member 1132. Next, the first wire 1150 is winded to the fourth side 1140 along the third circle 1156 and then winded in an interlaced manner into the first circle 1152 through the connecting member 1144. Finally, the first wire 1150 is winded to the first input terminal 1160.

Figure 2:
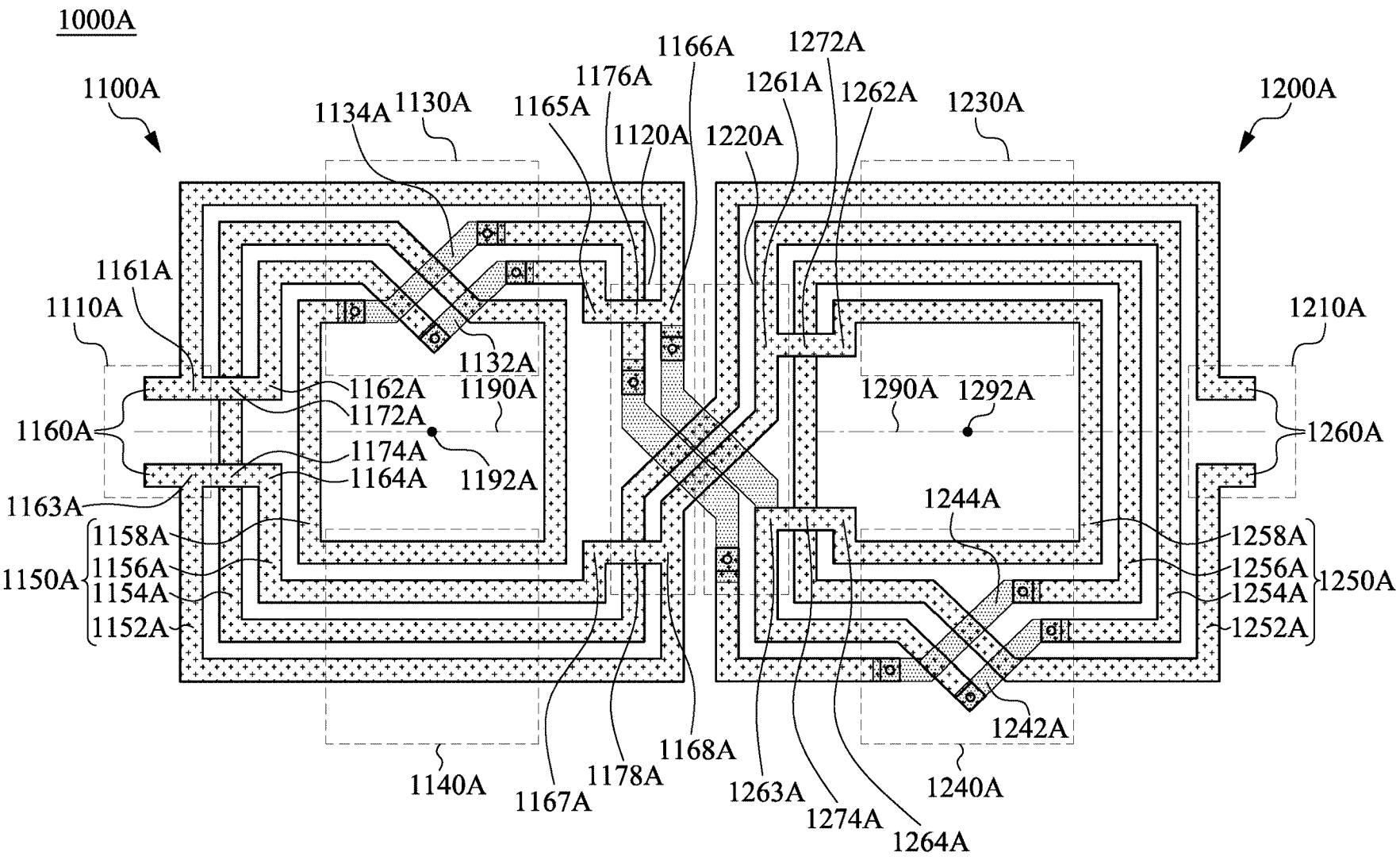
FIG. 2 is a schematic diagram of an inductor device according to some embodiments of the present disclosure.

FIG. 2 is a schematic diagram of an inductor device 1000A according to some embodiments of the present disclosure. It is noted that a difference between the inductor device 1000A of FIG. 2 and the inductor device 1000 of FIG. 1 is the arrangement of structure. For example, the inductor device 1000A further includes connecting parts 1172A, 1174A, 1176A, 1178A, 1272A and 1274A. However, the first circle 1152A of the inductor device 1000A is not coupled in an interlaced manner at the fourth side 1140A and is also not coupled in an interlaced manner at the seventh side 1230A.

Specifically, the connecting part 1172A is located at the first side 1110A, and is configured to couple the point 1161A of the first circle 1152A and the point 1162A of the third circle 1156A. The connecting part 1174A is also located at the first side 1110A, and is configured to couple the point 1163A of the first circle 1152A and the point 1164A of the third circle 1156A. The connecting part 1176A is located at the second side 1120A and is configured to couple the point 1166A of the first circle 1152A and the point 1165A of the third circle 1156A. The connecting part 1178A is also located at the second side 1120A, and is configured to couple the point 1168A of the first circle 1152A and the point 1167A of the third circle 1156A. In this embodiment, the first to fourth circles 1152A to 1158A are disposed from outside of the first wire 1150A to inside of the first wire 1150A in sequence.

Furthermore, the connecting part 1272A is located at the sixth side 1220A, and is configured to couple the point 1261A of the sixth circle 1254A and the point 1262A of the eighth circle 1258A. The connecting part 1274A is also located the second side 1220A and is configured to couple the point 1263A of the sixth circle 1254A and the point 1264A of the eighth circle 1258A. In this embodiment, the fifth to eighth circles 1252A to 1258A are disposed from outside of the second wire 1250A to inside of the second wire 1250A in sequence.

Figure 3:
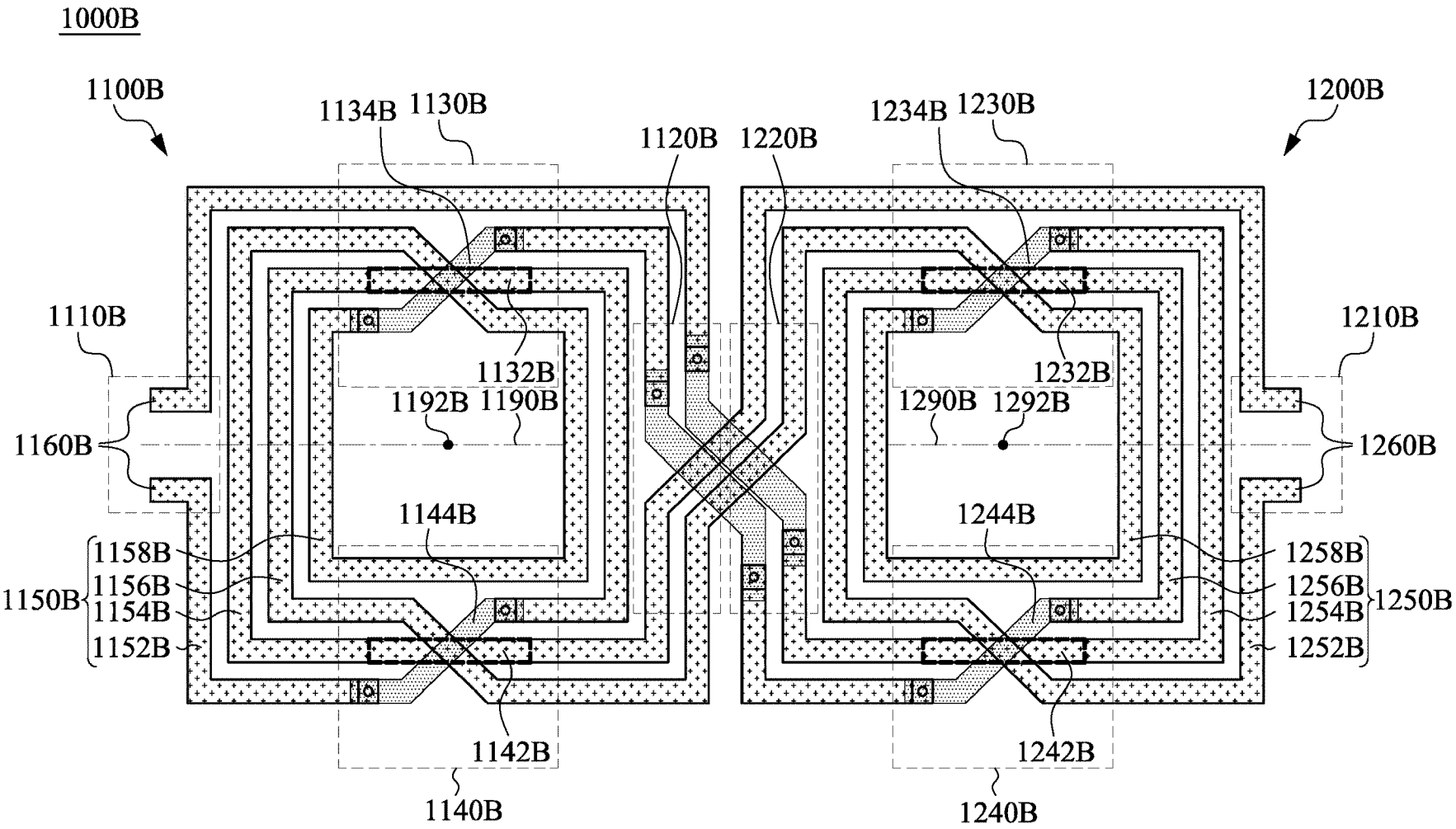
FIG. 3 is a schematic diagram of an inductor device according to some embodiments of the present disclosure.

FIG. 3 is a schematic diagram of an inductor device 1000B according to some embodiments of the present disclosure. It is noted that a difference between the inductor device 1000B of FIG. 3 and the inductor device 1000 of FIG. 1 is the arrangement of structure. For example, the first wire 1150B has a different coupling manner at the third side 11308 and the fourth side 1140B, and the second wire 1250B has a different coupling manner at the seventh side 1230B and the eighth side 1240B. Specifically, the first inductor unit 1100B includes connecting members 1132B and 1134B disposed at the third side 11308. The connecting member 1134B is located on the first wire 1150B, and is configured to connect two ends of the gap (e.g., the gap between the second circle 1154B and the fourth circle 1158B). The connecting member 1132B is located on the first wire 1150B and the connecting member 1134B, and is configured to connect two ends of the gap (the gap of the third circle 1156B located at the third side 1130B). The connecting member 1142B is also located on the first wire 1150 and the connecting member 1144B at the fourth side 11408. The other connecting manners are similar to the connecting manner in the third side 1130B, and the detailed description thereof will be omitted herein.

Likewise, the second inductor unit 1200B includes connecting member 1232B and 1234B disposed at the seventh side 12308. The connecting member 1234B is located on the second wire 12508, and is configured to connect two ends of the gap (e.g., the gap between the sixth circle 1254B and the eighth circle 1258B). The connecting member 1232B is located on the first wire 1250B and the connecting member 1234B, and is configured to connect two ends of the gap (e.g., the gap of the third circle 1256 located at the seventh side 1230B). The connecting member 1242B is also located on the second wire 1250B and the connecting member 1244B at the eighth side 1240B. The other connecting manners are similar to the connecting manner in the seventh side 1230B, and the detailed description thereof will be omitted herein.

Figure 4:
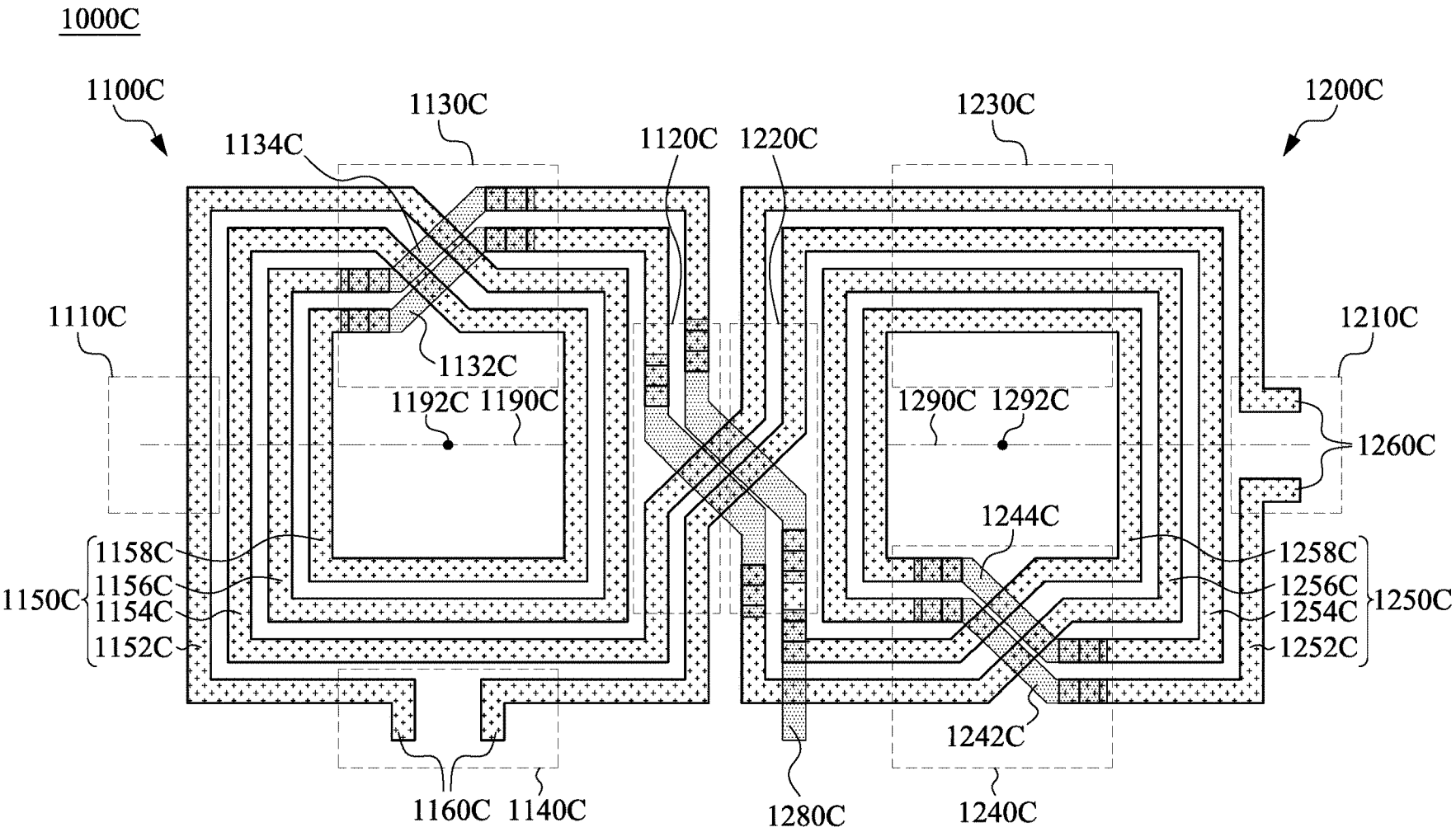
FIG. 4 is a schematic diagram of an inductor device according to some embodiments of the present disclosure.

FIG. 4 is a schematic diagram of an inductor device 1000C according to some embodiments of the present disclosure. It is noted that a difference between the inductor device 1000C of FIG. 4 and the inductor device 1000 of FIG. 1 is the winding manner of the wires.

In FIG. 4, the first wire 1150C is winded in an interlaced manner at the third side 1130C, and the second wire 1250C is winded in an interlaced manner at the eighth side 1240C. Moreover, the first input terminal 1160C is disposed at the fourth side 1140C, and the second input terminal 1260C is disposed at the fifth side 1210C. Furthermore, the first wire 1150C includes a first circle 1152C, a second circle 1154C, a third circle 1156C and a fourth circle 1158C, and the second wire 12500 includes a fifth circle 1252C, a sixth circle 1254C, a seventh circle 1256C and an eighth circle 1258C. The first wire 11500 is winded from the first input terminal 1160C leftward to the third side 1130C along the first circle 1152C and then winded in an interlaced manner into the third circle 1156C. Next, the first wire 1150C is winded to the third side 1130C along the third circle 1156C around the center point 1192C and then winded in an interlaced manner into the first circle 1152C through the connecting member 1134C. Next, the first wire 1150C is winded to the second side 1120C along the first circle 1152C and then winded in an interlaced manner into the sixth circle 1254C of the second wire 1250C.

Then, the second wire 1250C is winded to the eighth side 1240C along the sixth circle 1254C and then winded in an interlaced manner into the eighth circle 1258C. Next, the second wire 1250C is winded to the eighth side 1240C along the eighth circle 12580 around the center point 1292C and then winded in an interlaced manner into the sixth circle 1254C through the connecting member 1244C. The second wire 1250C is winded to the sixth side 1220C along the sixth circle 1254C around the center point 1292C and then winded in an interlaced manner into the first circle 1152C of the first wire 1150C. Finally, the second wire 1250C is winded to the first input terminal 1160C.

In one embodiment, the second inductor unit 1200C includes a center-tapped element 1280C. The center-tapped element 1280C is coupled to the second wire 1250C at the sixth side 1220C.

Figure 5:
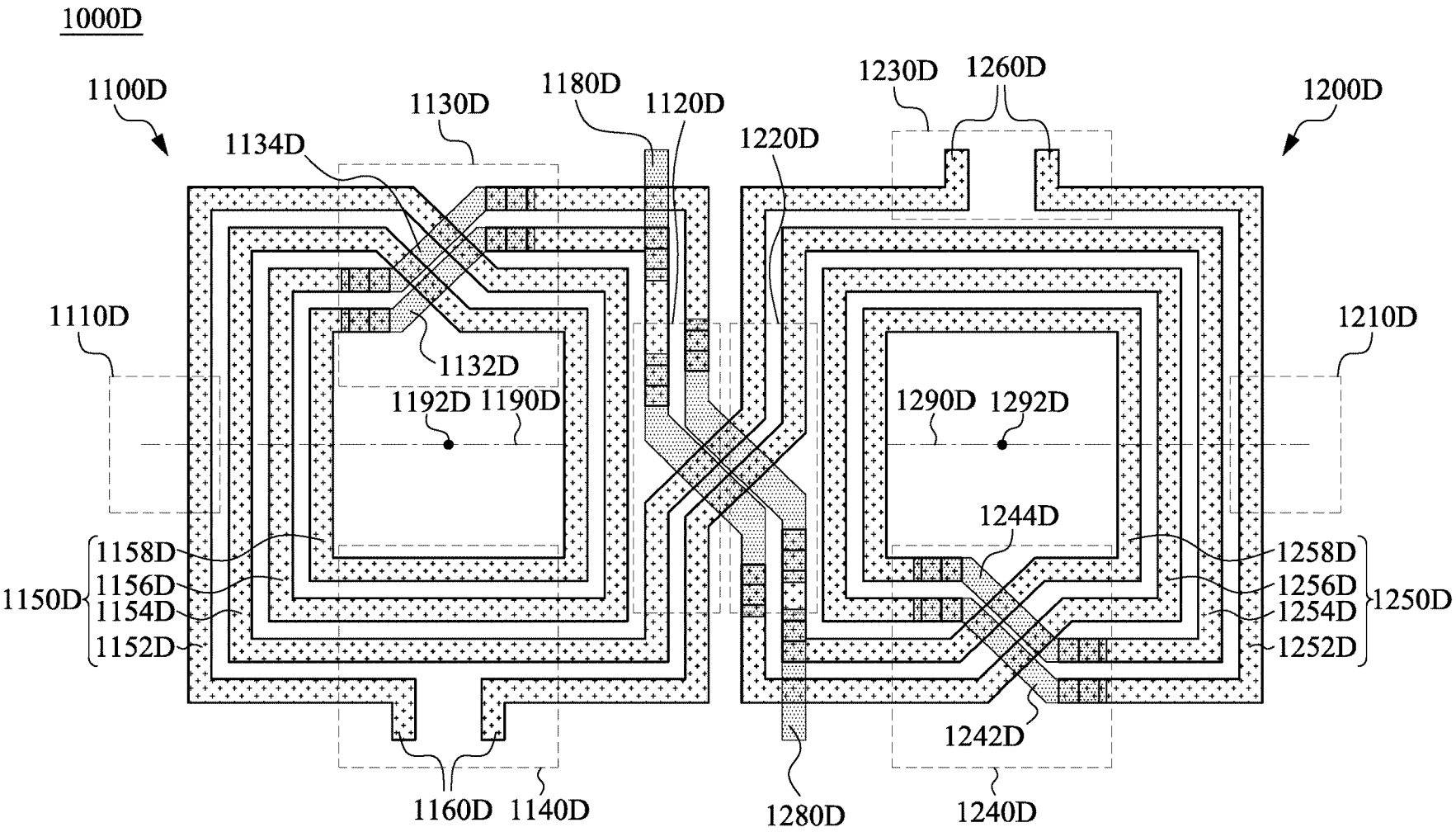
FIG. 5 is a schematic diagram of an inductor device according to some embodiments of the present disclosure.

FIG. 5 is a schematic diagram of an inductor device 1000D according to some embodiments of the present disclosure. It is noted that a difference between the inductor device 1000D of FIG. 5 and the inductor device 1000C of FIG. 4 is the arrangement of structure. For example, the second input terminal 1260D of the second inductor unit 1200D of FIG. 5 is disposed at the seventh side 1230D, and the second input terminal 1260C of FIG. 4 is disposed at the fifth side 1210C. Moreover, the first inductor unit 1100D of FIG. 5 further includes a center-tapped element 1180D (Center-Tap). The center-tapped element 1180D is coupled to the first wire 1150D at the second side 1120D. In another embodiment, the first input terminal 1160D and the second input terminal 1260D can be disposed as the same side.

Figure 6:
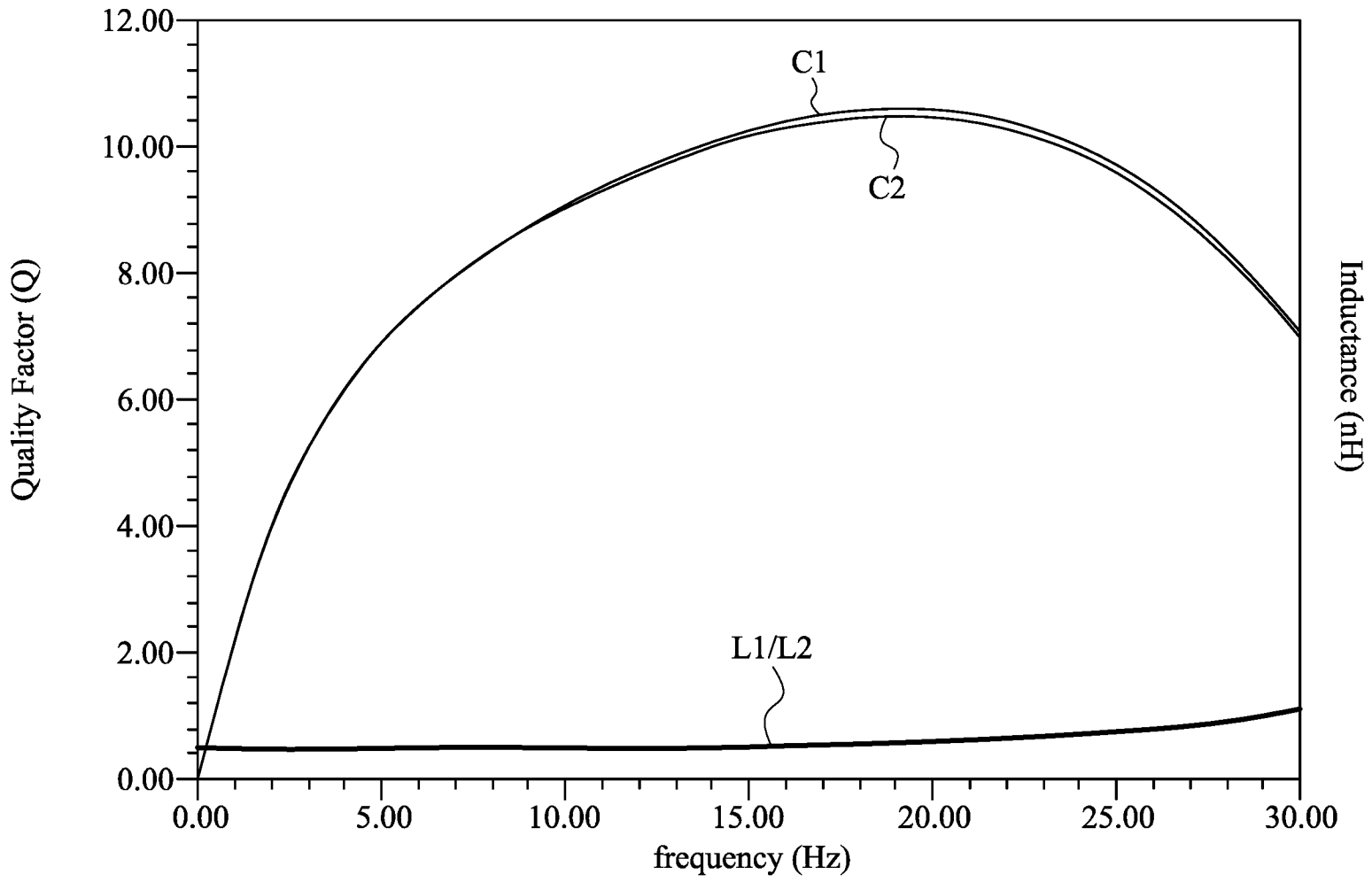
FIG. 6 depicts an experimental data diagram of an inductor device according to some embodiments of this disclosure.

FIG. 6 depicts an experimental data diagram of an inductor device according to some embodiments of this disclosure. The experimental data diagram is used for illustrating the quality factor (Q) and the inductance of the inductor device under different frequencies. As shown in figure, curves C1 and C2 show verification data of the quality factor (Q) of the first inductor unit and the second inductor unit of the inductor device of the present disclosure. It is thus known from the experimental data shown in FIG. 6 that the quality factor of the inductor device is about 11, and the inductances of the first inductor unit and the second inductor unit are approximately the same. This experimental result demonstrates that since structures of two inductor units of the inductor device are specifically arranged, the noise can therefore be reduced so as to enhance the efficiency of the inductor device.

It is therefore understood from the embodiments of the present disclosure that the present disclosure has the following advantages. The present disclosure provides an inductor device. Since structures of two inductor units of the inductor device are arranged, the problem of performance of a conventional 8-shaped transformer being affected because the structure of the 8-shaped transformer is not symmetrical can be solved.

What is claimed is:

1. An inductor device, comprising:

a first inductor unit, comprises:

a first side and a second side respectively disposed at two opposite sides of the first inductor unit, wherein the first inductor unit comprises a third side and a fourth side located at two opposite sides of a first central line, wherein the first central line is across and between the first and second sides;

a first wire winded to form a plurality of circles, wherein the first wire is winded in an interlaced manner at at least one of the first to fourth sides of the first inductor unit; and a first input terminal disposed on one side of the first side, the second side, the third side and the fourth side of the first inductor unit; and a second inductor unit, comprising:

a fifth side and a sixth side respectively disposed at two opposite sides of the second inductor unit, wherein the second inductor unit comprises a seventh side and an eighth side located at two opposite sides of a second central line, wherein the second central line is across and between the fifth and sixth sides;

a second wire winded to form a plurality of circles, wherein the second wire is winded in an interlaced manner at at least one of the fifth to eighth sides of the second inductor unit; and a second input terminal disposed on one of the fifth to eighth sides of the second inductor unit;

wherein the first wire and the second wire are winded in an interlaced manner at the second side and the sixth side, wherein the first wire is crossing at the third side, and the second wire is crossing at the eighth side, wherein the first central line and the second central line are a same line, wherein the third side and the eighth side are located at two opposite sides of the first central line and the second central line.

2. The inductor device of claim 1, wherein the first input terminal is disposed at the first side, and the second input terminal is disposed at the fifth side.

3. The inductor device of claim 1, wherein the first wire is further crossing the fourth side, and the second wire is further crossing at the seventh side.

4. The inductor device of claim 2, wherein the first wire comprises:

at least two gaps located the third side or the fourth side;

wherein the first inductor unit further comprises:

at least two connecting members disposed at the third side or the fourth side, and located on the first wire, wherein the at least two connecting members are configured to connect two ends of the at least two gaps;

wherein the second wire comprises:

at least two gaps located at the seventh side or the eighth side;

wherein the second inductor unit further comprises:

at least two connecting members disposed at the seventh side or the eighth side, and located on the second wire, wherein the at least two connecting members are configured to connect two ends of the at least two gaps.

5. The inductor device of claim 4, wherein the first wire comprises a first circle, a second circle, a third circle and a fourth circle, the second wire comprises a fifth circle, a sixth circle, a seventh circle and an eighth circle, wherein the first wire is winded from the first side to the second side along the first circle and then winded in an interlaced manner into the sixth circle of the second wire, next winded to the eighth side along the sixth circle and then winded in an interlaced manner into the sixth circle, next winded to the seventh side along the sixth circle and then winded in an interlaced manner into the eighth circle, wherein the second wire is winded to the seventh side along the eighth circle and then winded in an interlaced manner into the sixth circle, next winded to the sixth side along the sixth circle and then winded in an interlaced manner into the first circle of the first wire.

6. The inductor device of claim 5, wherein the first wire is winded to the fourth side along the first circle and then winded in an interlaced manner into the third circle, next winded to the third side along the third circle and then winded in an interlaced manner into the third circle, next winded to the fourth side along the third circle and then winded in an interlaced manner into the first circle.

7. The inductor device of claim 3, wherein the first wire comprises:

a first gap and a second gap located the third side or the fourth side;

wherein the first inductor unit further comprises:

a first connecting member disposed at the third side or the fourth side, and located on the first wire, wherein the first connecting member is configured to connect two ends of the first gap; and a second connecting member disposed at the third side or the fourth side, and located on the first wire and the first connecting member, wherein the second connecting member is configured to connect two ends of the second gap;

wherein the second wire comprises:

a third gap and a fourth gap located at the seventh side or the eighth side;

wherein the second inductor unit further comprises:

a third connecting member disposed at the seventh side or the eighth side, and located on the second wire, wherein the third connecting member is configured to connect two ends of the third gap; and a fourth connecting member disposed at the seventh side or the eighth side, and located on the second wire and the first connecting member, wherein the fourth connecting member is configured to connect two ends of the fourth gap.

8. The inductor device of claim 7, wherein the first wire comprises a first circle, a second circle, a third circle and a fourth circle, the second wire comprises a fifth circle, a sixth circle, a seventh circle and a eighth circle, wherein the first wire is winded from the first side to the second side along the first circle and then winded in an interlaced manner into the sixth circle of the second wire, next winded to the eighth side along the sixth circle and then winded into the sixth circle through the fourth connecting member, next winded to the seventh side along the sixth circle and then winded in an interlaced manner into the eighth circle through the third connecting member, wherein the second wire is winded to the seventh side along the eighth circle and then winded in an interlaced manner into the sixth circle, next winded to the sixth side along the sixth circle and then winded in an interlaced manner into the first circle of the first wire.

9. The inductor device of claim 8, wherein the first wire is winded to the fourth side along the first circle and then winded in an interlaced manner into the third circle, next winded to the third side along the third circle and then winded into the third circle through the second connecting member, next winded to the fourth side along the third circle and then winded in an interlaced manner into the first circle through the first connecting member.

10. The inductor device of claim 1, wherein the first wire comprises:

a first circle, a second circle, a third circle and a fourth circle disposed from outside of the first wire to inside of the first wire in sequence;

at least two gaps located at the third side;

wherein the first inductor unit further comprises:

at least two connecting members disposed at the third side, and located on the first wire, wherein the at least two connecting members are configured to connect two ends of the at least two gaps; and at least two connecting parts, wherein one of the at least two connecting parts is coupled to the first circle and the third circle at the first side, another of the at least two connecting parts is coupled to the first circle and the third circle at the second side.

11. The inductor device of claim 10, wherein the second wire comprises:

a fifth circle, a sixth circle, a seventh circle and a eighth circle disposed from outside of the second wire to inside of the second wire in sequence;

at least two gaps located at the eighth side;

wherein the second inductor unit further comprises:

at least two connecting members disposed at the eighth side, and located on the second wire, wherein the at least two connecting members are configured to connect two ends of the at least two gaps; and at least one connecting part coupled to the sixth circle and the eighth circle at the sixth side.

12. The inductor device of claim 1, wherein the first input terminal is disposed at the fourth side, and the second input terminal is disposed at the fifth side.

13. The inductor device of claim 12, wherein the first wire comprises a first circle, a second circle, a third circle and a fourth circle, the second wire comprises a fifth circle, a sixth circle, a seventh circle and a eighth circle, wherein the first wire is winded from the first input terminal to the third side along the first circle and then winded in an interlaced manner into the third circle, next winded to the third side along the third circle and then winded in an interlaced manner into the first circle, next winded to the second side along the first circle and then winded in an interlaced manner into the sixth circle of the second wire.

14. The inductor device of claim 13, wherein the second wire is winded to the eighth side along the sixth circle and then winded in an interlaced manner into the eighth circle, next winded to the eighth side along the eighth circle and then winded in an interlaced manner into the sixth circle, wherein the second wire is winded to the sixth side along the sixth circle and then winded in an interlaced manner into the first circle of the first wire.

15. The inductor device of claim 14, wherein the second inductor unit further comprises:

a center-tapped element coupled to the second wire at the sixth side.

16. The inductor device of claim 1, wherein the first input terminal is disposed at the fourth side, and the second input terminal is disposed at the seventh side.

17. The inductor device of claim 16, wherein the first wire comprises a first circle, a second circle, a third circle and a fourth circle, the second wire comprises a fifth circle, a sixth circle, a seventh circle and a eighth circle, wherein the first wire is winded from the first input terminal to the third side along the first circle and then winded in an interlaced manner into the third circle, next winded to the third side along the third circle and then winded in an interlaced manner into the first circle, next winded to the second side along the first circle and then winded in an interlaced manner into the sixth circle of the second wire.

18. The inductor device of claim 17, wherein the second wire is winded to the eighth side along the sixth circle and then winded in an interlaced manner into the eighth circle, next winded to the eighth side along the eighth circle and then winded in an interlaced manner into the sixth circle, wherein the second wire is winded to the sixth side along the sixth circle and then winded in an interlaced manner into the first circle of the first wire.

19. The inductor device of claim 18, wherein the first inductor unit further comprises:

a first center-tapped element coupled to the first wire at the second side;

wherein the second inductor unit further comprises:

a second center-tapped element coupled to the second wire at the sixth side.

* * * * *